US007143958B1

(12) United States Patent
Dorney

(10) Patent No.: US 7,143,958 B1
(45) Date of Patent: Dec. 5, 2006

(54) MISTING BOTTLE SYSTEM

(75) Inventor: Peter Dorney, Winter Springs, FL (US)

(73) Assignee: Whirley Industries, Inc., Warren, PA (US)

( * ) Notice: Subject to any disclaimer, the term of this patent is extended or adjusted under 35 U.S.C. 154(b) by 0 days.

(21) Appl. No.: 11/090,635

(22) Filed: Mar. 25, 2005

(51) Int. Cl.
*B05B 15/00* (2006.01)

(52) U.S. Cl. ..... 239/289; 239/215; 239/222.11; 239/333; 239/33; 222/192; 222/321.9; 222/331; 215/229; 220/705

(58) Field of Classification Search ..... 239/222.11, 239/261, 289, 379, 215, 33, 333; 222/129, 222/380, 192, 331, 321.7, 321.9
See application file for complete search history.

(56) References Cited

U.S. PATENT DOCUMENTS 5,752,662 A * 5/1998 Hsu ..... 239/215
6,010,034 A * 1/2000 Walthers ..... 222/135
6,161,777 A * 12/2000 Carter et al. ..... 239/222.11

* cited by examiner

*Primary Examiner*—Dinh Q. Nguyen
(74) *Attorney, Agent, or Firm*—The Bilicki Law Firm, PC

(57) ABSTRACT

A housing has walls terminating with an opening and a circular aperture adapted to hold a bottle. A fan assembly has a motor within the housing. The fan assembly has propellers exterior of the housing. The fan assembly has a rotatable shaft and a button. The button is operatively coupled to the motor. A spray assembly has a tube. The tube has an input end and an outlet end. A trigger extends through the opening. A pump operatively couples the trigger and the tube. A drinking assembly has a passageway extending through the housing. The drinking assembly has a straw. The straw has a lower end positionable within the bottle and an upper end positioned above the housing.

5 Claims, 4 Drawing Sheets

MISTING BOTTLE SYSTEM

BACKGROUND OF THE INVENTION

1. Field of the Invention

The present invention relates to a misting bottle system and more particularly pertains to a system for cooling the face of a user with a moist breeze while allowing the user to drink water from the system.

2. Description of the Prior Art

The use of misting systems of known designs and configurations is known in the prior art. More specifically, misting systems of known designs and configurations previously devised and utilized for the purpose of cooling a user through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,338,495 issued Aug. 16, 1994 to Steiner relates to a portable misting fan. U.S. Pat. No. Des. 349,954 issued Aug. 23, 1994 to Steiner relates to a combined portable fan and spray bottle. U.S. Pat. No. 5,851,106 issued Dec. 22, 1998 to Steiner relates to a portable fan device. Lastly, U.S. Pat. No. 5,897,027 issued Apr. 27, 1999 to Steiner relates to a novelty mountable head.

While these devices fulfill their respective, particular objectives and requirements, the aforementioned patents do not describe misting bottle system that allows for cooling the face of a user with a moist breeze while allowing the user to drink water from the system.

In this respect, the misting bottle system according to the present invention substantially departs from the conventional concepts and designs of the prior art, and in doing so provides an apparatus primarily developed for the purpose of cooling the face of a user with a moist breeze while allowing the user to drink water from the system.

Therefore, it can be appreciated that there exists a continuing need for a new and improved misting bottle system which can be used for cooling the face of a user with a moist breeze while allowing the user to drink water from the system. In this regard, the present invention substantially fulfills this need.

SUMMARY OF THE INVENTION

In view of the foregoing disadvantages inherent in the known types of misting systems of known designs and configurations now present in the prior art, the present invention provides an improved misting bottle system. As such, the general purpose of the present invention, which will be described subsequently in greater detail, is to provide a new and improved misting bottle system and method which has all the advantages of the prior art and none of the disadvantages.

To attain this, the present invention essentially comprises a misting bottle system. First provided in the system is a hollow housing. The hollow housing a flat forward extent. The housing has a generally hemispherical rearward extent. The housing has a generally cylindrical central extent. The central extent is provided between the forward and rearward extents. The forward extent has a central threaded aperture. The central circular aperture has a central axis. The central axis is essentially coextensive with the axis of the rearward extent. The central extent has downwardly extending walls. An opening is provided in the downwardly extending walls.

The walls terminate at a circular female threaded aperture at a location adjacent to the rearward extent.

A bottle is next provided. The bottle is adapted to hold a quantity of water. The bottle has a closed lower end and an upper end. The bottle is formed with a male threaded aperture. The male threaded aperture is adapted to releasably couple with respect to the female threaded aperture of the housing.

Provided next is a fan assembly. The fan assembly includes a motor. The motor is provided within the housing. The motor is supported interior of the forward extent of the housing. The fan assembly has propellers. The propellers are rotatably supported exterior of the forward extent of the housing. The fan assembly has a rotatable shaft. The rotatable shaft extends through the circular aperture and coupling the motor and the shaft. The fan assembly also includes a button. The button is provided on the housing diametrically opposed from the walls. The button is operatively coupled to the motor. In this manner the button will activate the motor and rotate the shaft to rotate the propellers when depressed and a breeze is created. Depressing the button again will inactivate the motor to stop the rotation of the shaft and propellers and thereby terminate the breeze.

Further provided is a spray assembly. The spray assembly includes a tube. The tube has an input end. The input end is located in the bottle adjacent to the lower end. An outlet end is provided. The outlet end is provided adjacent to the forward extent of the housing. The tube has a central length. The central length is provided between the ends and within the walls. The spray assembly also includes a trigger. The trigger is pivotably coupled to the walls. The trigger extends through the opening in the walls. The spray assembly has a pump. The pump operatively couples the trigger and the central length of the tube. In this manner pulling the trigger will pump water from the bottle to a region in proximity to the propellers so that when the trigger is pulled while the motor is activated, a cooling mist will be sprayed forwardly of the propellers by a user pulling the trigger.

Provided last is a drinking assembly. The drinking assembly includes a passageway. The passageway extends through the housing. The passageway has a lower end in proximity to the central extent and the rearward extent of the housing. The passageway has an upper end in proximity to a central part of the central extent of the housing. The drinking assembly also includes a straw. The straw has a lower end. The lower end is positioned within the bottle adjacent to its lower end. The straw has an upper end. The upper end is positioned above the housing for being held by the lips of a user for sipping water from within the bottle. The straw has a central extent positioned within the passageway.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved misting bottle system which has all of the advantages of the prior art misting systems of known designs and configurations and none of the disadvantages.

It is another object of the present invention to provide a new and improved misting bottle system which may be easily and efficiently manufactured and marketed.

It is further object of the present invention to provide a new and improved misting bottle system which is of durable and reliable constructions.

An even further object of the present invention is to provide a new and improved misting bottle system which is susceptible of a low cost of manufacture with regard to both materials and labor, and which accordingly is then susceptible of low prices of sale to the consuming public, thereby making such misting bottle system economically available to the buying public.

Even still another object of the present invention is to provide a misting bottle system for cooling the face of a user with a moist breeze while allowing the user to drink water from the system.

Lastly, it is an object of the present invention to provide a new and improved misting bottle system. A housing has walls terminating with an opening and a circular aperture adapted to hold a bottle. A fan assembly has a motor within the housing. The fan assembly has propellers exterior of the housing. The fan assembly has a rotatable shaft and a button. The button is operatively coupled to the motor. A spray assembly has a tube. The tube has an input end and an outlet end. A trigger extends through the opening. A pump operatively couples the trigger and the tube. A drinking assembly has a passageway extending through the housing. The drinking assembly has a straw. The straw has a lower end positionable within the bottle. The straw has an upper end positioned above the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE EMBODIMENTS

Figure 1:
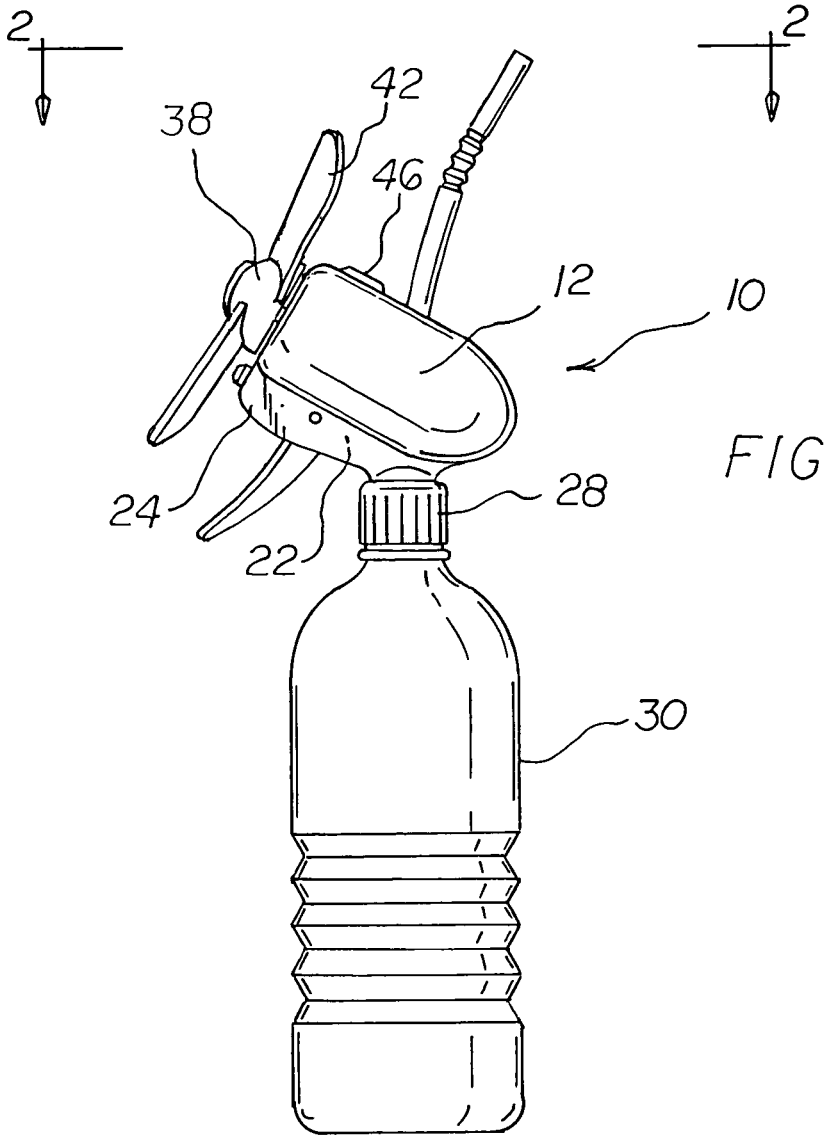
FIG. 1 is a side elevational view of a misting bottle system.

With reference to FIG. 1, misting bottle system 10 is comprised of a plurality of component including a housing, a spray assembly, a fan assembly and a drinking assembly. Such components are individually configured and correlated with respect to each other so as to attain the desired objective.

Figure 2:
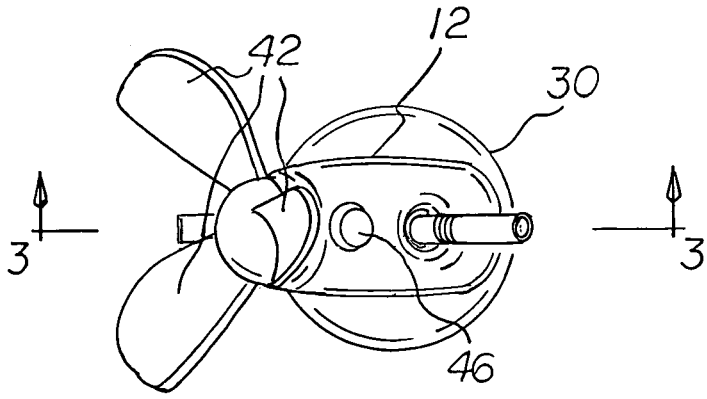
FIG. 2 is a plan view of the system taken at line 2—2 of FIG. 1.
Figure 3:
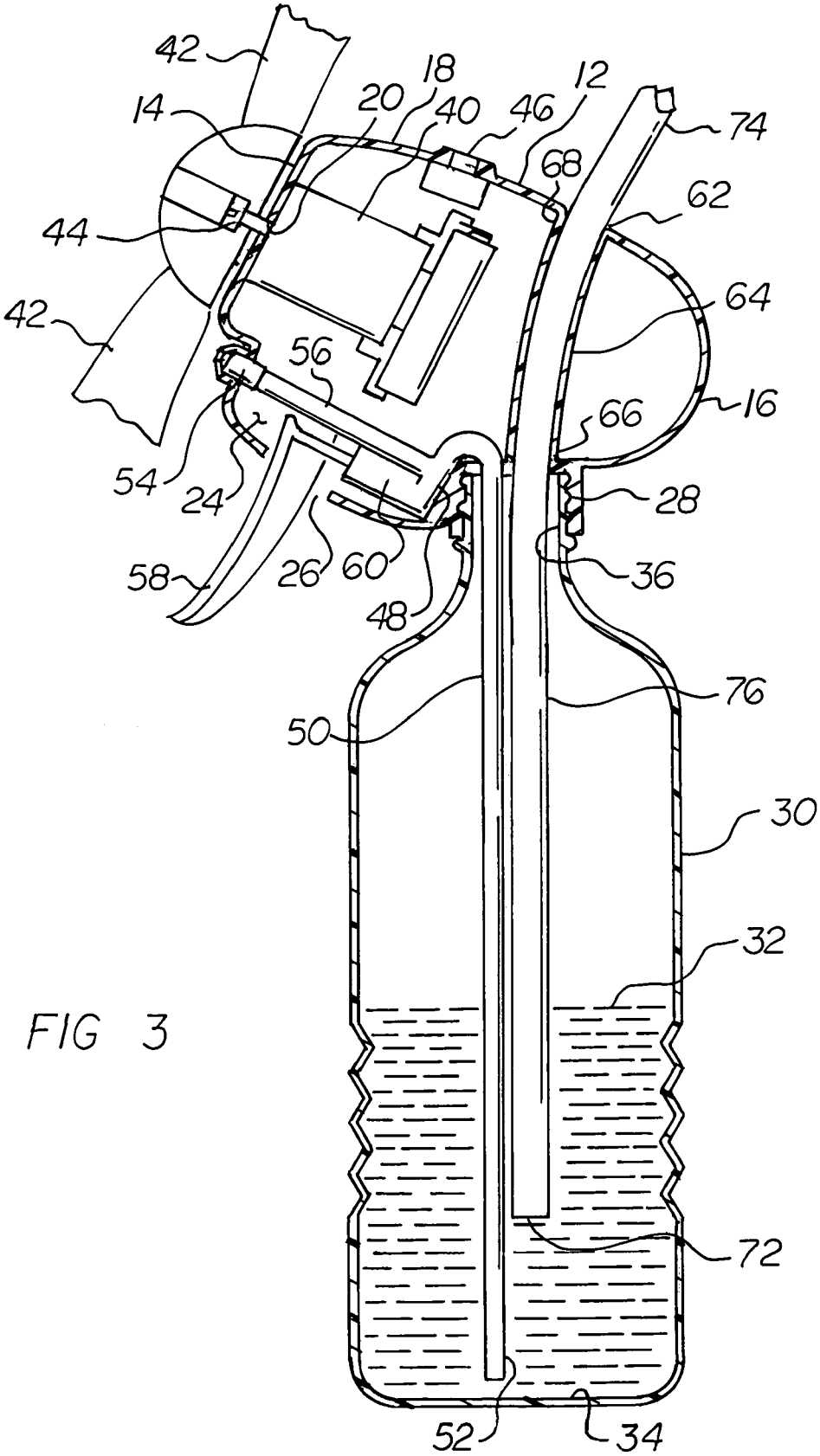
FIG. 3 is a cross sectional view of the system taken at line 3—3 of FIG. 2.

As illustrated in FIGS. 1, 2 and 3, one embodiment of misting bottle system 10 includes a hollow housing 12 having a flat forward extent 14. Housing 12 includes a generally hemispherical rearward extent 16 and a generally cylindrical central extent 18. Central extent 18 is provided between forward extent 14 and rearward extent 16. Forward extent 14 includes a central circular aperture 20 with a central axis (not separately labeled). The central axis is essentially coextensive with an axis of rearward extent 16. Central extent 18 has downwardly extending walls 22 and 24. An opening 26 is provided in downwardly extending walls 22 and 24. Walls 22 and 24 terminate at a circular female threaded aperture 28 at a location adjacent to rearward extent 16.

A bottle 30 is provided for holding a quantity of water 32. Bottle 30 includes a closed lower end 34 and an upper end (not separately labeled). In addition, bottle 30 is formed with a male threaded aperture 36, which is adapted to releasably couple to female threaded aperture 28 of housing 12.

Misting bottle system 10 also includes a fan assembly 38. Fan assemlby 38 includes a motor 40, propellers 42, a rtatable shaft 44 and a button 46. Motor 40 is positioned within housing 12 and is supported interior of forward extent 14 of housing 12. Fan assembly 38 also includes propellers 42, which are rotatably supported exterior of forward extent 14 housing 12. Rotatable shaft 44 extends through circular aperture 20 and couples motor 40 to propellers 42. Fan assembly 38 also includes button 46, which is provided on housing 12 diametrically opposed from walls 22 and 24. Button 46 is operatively coupled to motor 40. In this manner, button 46 will activate motor 40 and rotate shaft 44 to rotate propellers 42 when depressed and a breeze is created. Depressing button 46 again will inactivate motor 40 to stop the rotation of shaft 44 and propellers 42, thereby terminate the breeze.

Further, misting bottle system 10 includes a spray assembly 48. Spray assembly 48 includes a tube 50 having an input end 52. Input end 52 is located within bottle 30 adjacent to lower end 34. An outlet end 54 is provided adjacent to forward extent 14 of housing 12. Tube 50 has a central length 56 provided between input end 52 and outlet end 54 and between downwardly extending walls 22 and 24 of house 12. Spray assembly 48 also includes a trigger 58. Trigger 58 is pivotably coupled to downwardly extending walls 22 and 24 and extends through opening 26 in downwardly extending walls 22 and 24. Spray assembly 48 further includes a pump 60 for operatively coupling trigger 58 and central length 56 of tube 50. When trigger 58 is pulled, water is pumped from bottle 30 into a region in the proximity of propellers 42. Therefore, when trigger 58 is pulled while motor 40 is activated, a cooling mist is sprayed forwardly of propellers 42.

A drinking assembly 62 is also included in misting bottle system 10. Drinking assembly 62 includes a passageway 64 that extends through housing 12. Passageway 64 includes a lower end 66 in proximity to central extent 18 and rearward extent 16 of housing 12. Passageway 64 also has an upper end 68 in proximity to a central part of central extent 18 of housing 12. Drinking assembly 62 includes a straw 76. Straw 76 has a lower end 72, which is positioned within bottle 30 adjacent to lower end 34 and an upper end 74 positioned above housing 12 for allowing a user to sip water from within bottle 30. Further, straw 76 has a central extent (not separately labeled) positioned within passageway 64.

Figure 4:
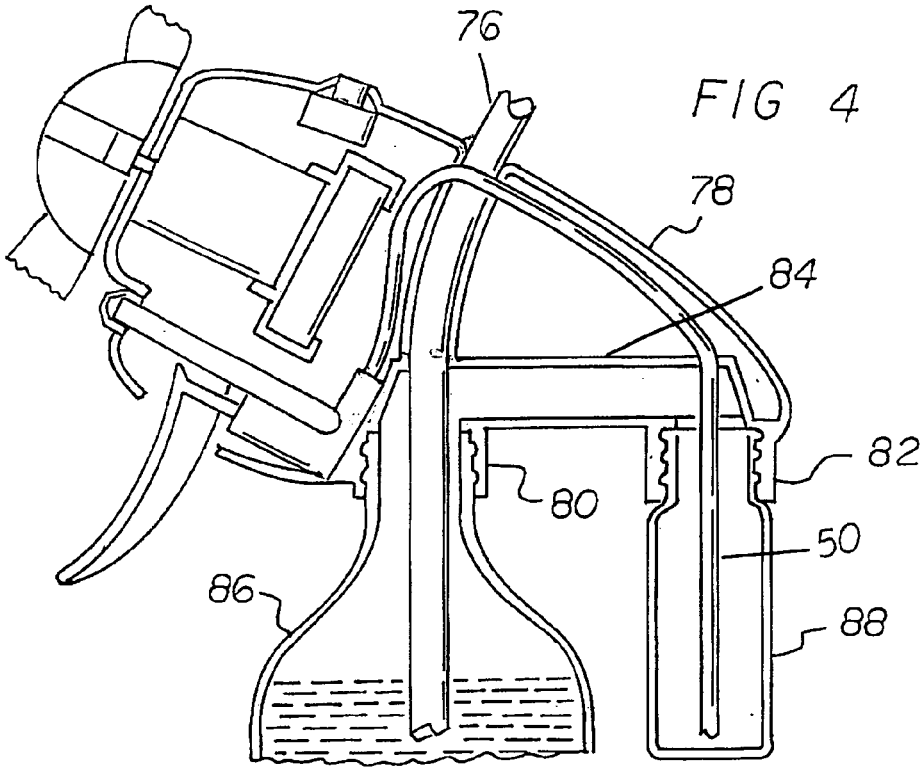
FIG. 4 is an enlarged cross-sectional view of an upper portion of an alternate embodiment of a misting bottle system.
Figure 5:
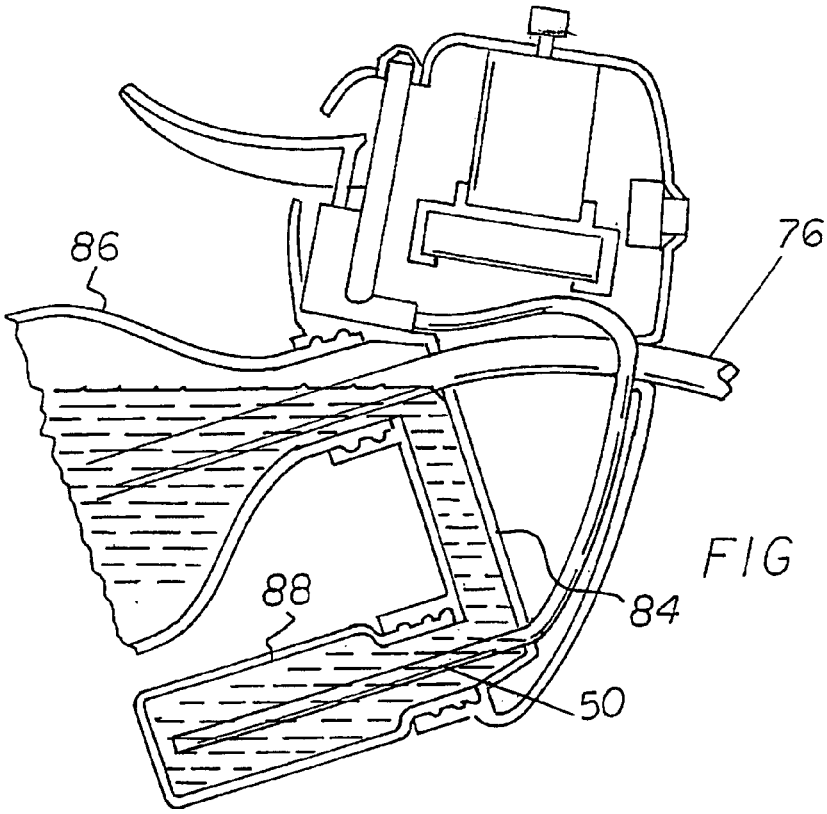
FIG. 5 is a cross sectional view of the embodiment shown in FIG. 4 but in a tilted orientation to illustrate the filling of the smaller bottle from the larger bottle.

An alternate embodiment of the misting bottle system is illustrated in FIGS. 4 and 5. Most of the components of the alternate embodiment are similar to the component described with reference to FIGS. 1–3. In the alternate embodiment, however, a housing 78 is configured to include two laterally spaced circular threaded apertures 80 and 82. Housing 78 includes a passageway 84 between spaced circular threaded apertures 80 and 82. A larger bottle 86 is releasably coupled to circular threaded aperture 80. A smaller bottle 88 is coupled to circular threaded aperture 82. Tube 50 extends downwardly into smaller bottle 88 while straw 76 extends downwardly into larger bottle 86. Passageway 84 couples circular threaded apertures 80 and 82. Therefore, smaller bottle 88 may be filled from larger bottle 86 or vice versa by tipping misting bottle system 10 as illustrated in FIG. 5.

Figure 6:
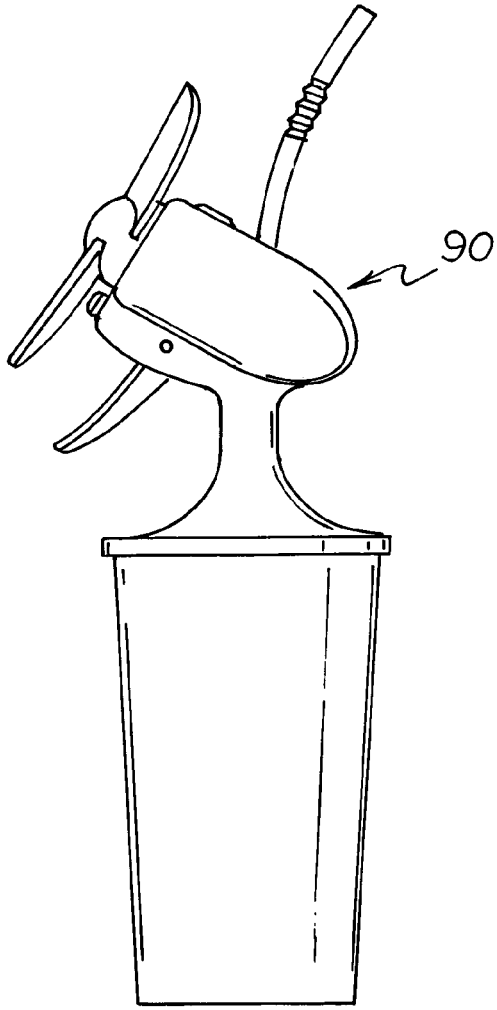
FIG. 6 is a side elevational view similar to FIG. 1 but illustrating another alternate embodiment of the invention.
Figure 7:
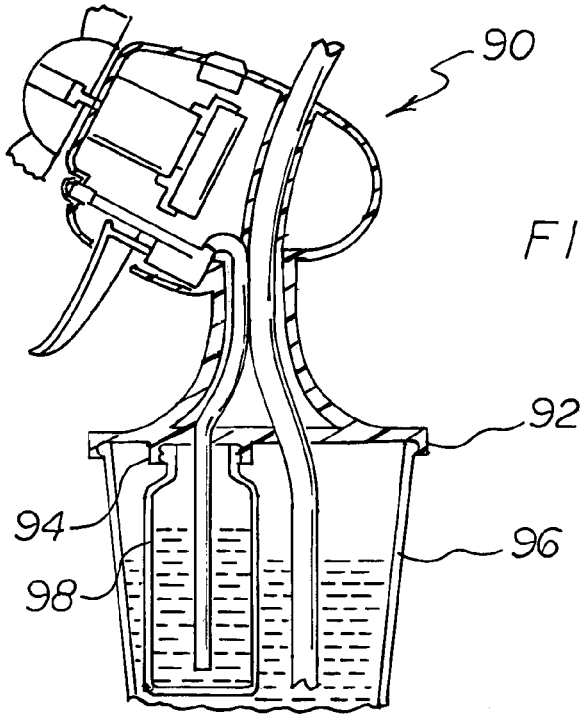
FIG. 7 is a cross sectional view of the system shown in FIG. 6.

Another alternate embodiment of the misting bottle system, generally indicated at 90, is illustrated in FIGS. 6 and 7. In such embodiment, the housing (not separately labeled in this embodiment) includes two circular apertures 92 and 94. First circular aperture 92 surrounds second circular aperture 94. A larger cup 96, which may include a snap on coupling, is shown attached to first circular aperture 92. Larger cup 96 may be a soft drink cup. A larger bottle may be releasably coupled to first circular aperture 92, which may be a threaded aperture. A smaller bottle 98, such as for water, is also included. Smaller bottle 98 is coupled to threaded second circular aperture 94 and is positioned within larger cup 96.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A misting bottle system comprising:

a housing having walls terminating with an opening and a circular aperture adapted to hold a bottle;

a fan assembly including a motor within the housing and propellers exterior of the housing with a rotatable shaft there between and with a button operatively coupled to the motor;

a spray assembly including a tube having an input end and an outlet end with a trigger extending through the opening and a pump operatively coupling the trigger and the tube; and a drinking assembly including a passageway extending through the housing and a straw extending through said passageway, said straw having a lower end positionable within a bottle and an upper end positioned above the housing.

2. The system as set forth in claim 1 wherein a single bottle receives the tube and the straw.

3. The system as set forth in claim 1 wherein the housing includes two laterally spaced threaded apertures and further including a passageway coupling the two threaded apertures with a larger bottle releasably coupled to one threaded aperture and a smaller bottle coupled to the other threaded aperture.

4. The system as set forth in claim 1 wherein the housing includes two circular apertures, one within the other with a larger cup releasably coupled to one of the circular apertures through a snap on coupling, and a smaller bottle coupled to the other circular aperture through a threaded coupling.

5. A misting bottle system for cooling the face of a user with a moist breeze while allowing the user to drink water from the system comprising, in combination:

a hollow housing having a flat forward extent with an axis, a generally hemispherical rearward extent with an axis, and a generally cylindrical central extent there between, the forward extent having a central circular aperture with a central axis essentially coextensive with the axis of the rearward extent and the axis of the central extent, the central extent having downwardly extending walls with an opening therein, the downwardly extending walls terminating with a female threaded aperture at a location adjacent to the rearward extent;

a bottle adapted to hold a quantity of water, the bottle having a closed lower end and an upper end formed with a male threaded aperture adapted to relaseably couple with respect to the female threaded aperture of the housing;

a fan assembly including a motor within the housing supported interior of the forward extent of the housing and propellers rotatably supported exterior of the forward extent of the housing with a rotatable shaft extending through the circular aperture and coupling the motor and the shaft, the fan assembly also including a button on the housing diametrically opposed from the walls operatively coupled to the motor whereby depressing the button will activate the motor and rotate the shaft to rotate the propellers and thereby create a breeze and whereby depressing the button again will inactivate the motor to stop the rotation of the shaft and propellers and thereby terminate the breeze;

a spray assembly including a tube having an input end located in the bottle adjacent to the lower end and an outlet end adjacent to the forward extent of the housing with a central length there between within the walls, the spray assembly also including a trigger pivotably coupled to the walls and extending through the opening in the walls with a pump operatively coupling the trigger and the central length of the tube whereby pulling the trigger will pump water from the bottle to a region in proximity to the propellers so that when the trigger is pulled while the motor is activated, a cooling mist will be sprayed forwardly of the propellers by a user pulling the trigger; and a drinking assembly including a passageway extending through the housing with a lower end in proximity to the central extent and rearward extent of the housing and an upper end in proximity to a central part of the central extent of the housing, the drinking assembly also including a straw with a lower end positioned within the bottle adjacent to its lower end and an upper end positioned above the housing for being held by the lips of a user for sipping water from within the bottle, the straw having a central extent positioned within the passageway.

* * * * *

UNITED STATES PATENT AND TRADEMARK OFFICE

CERTIFICATE OF CORRECTION

PATENT NO. : 7,143,958 B1
APPLICATION NO. : 11/090635
DATED : December 5, 2006
INVENTOR(S) : Peter Dorney It is certified that error appears in the above-identified patent and that said Letters Patent is hereby corrected as shown below:

Column 1, line 59, "The hollow housing a flat forward extent." and replace it with --The hollow housing has a flat forward extent.--

Column 3, lines 16-18, "It is further object of the present invnetion to provide a new and improved misting bottle system which is of durable and reliable construction." and replace it with --It is further an object of the present invention to provide a new and improved misting bottle system which is of durable and reliable construction.--

Column 4, line 42, "Misting bottle system 10 also includes a fan assemlby 38." and replace it with --Misting bottle system 10 also includes a fan assembly 38.--

Column 4, lines 43-44 "Fan assembly 38 includes a motor 40, propellers 42, a rtatable shaft 44 and a button 46." and replace it with --Fan assembly 38 includes a motor 40, propellers 42, a rotatable shaft 44 and a button 46.--

Signed and Sealed this

Seventeenth Day of April, 2007

JON W. DUDAS
*Director of the United States Patent and Trademark Office*